US005551921A

United States Patent [19]

Fukano

[11] Patent Number: 5,551,921

[45] Date of Patent: Sep. 3, 1996

[54] COIN MAGIC DEVICE

[75] Inventor: Atsushi Fukano, Tokyo, Japan

[73] Assignee: Tenyo Co., Ltd., Tokyo, Japan

[21] Appl. No.: 504,958

[22] Filed: Jul. 20, 1995

[30] Foreign Application Priority Data

Jul. 22, 1994 [JP] Japan ..... 6-171193

[51] Int. Cl.[6] ..... A63J 5/00

[52] U.S. Cl. ..... 472/69; 428/68; 428/137

[58] Field of Search ..... 428/68, 99, 137; 206/0.8; 472/69

*Primary Examiner*—Alexander Thomas

*Attorney, Agent, or Firm*—Sixbey, Friedman, Leedom & Ferguson, P.C.; Gerald J. Ferguson, Jr.

[57] ABSTRACT

A coin magic device is disclosed which comprises a coin holder in which a coin is to be set, and a case into which the coin holder is to be introduced. The coin holder has formed on one side thereof a concavity which has a through-hole formed in the bottom thereof and in which the coin is to be set. The case has formed on the inner surface thereof a guide wall to guide the coin moving inside the case.

The coin is set in the concavity of the coin holder. They are introduced into the case. When a key is inserted through the case from one of the slits in the case, the coin is moved from a set position to a offset position as guided by the guide wall. Thus, the key can be inserted through the slits in the case and through-hole in the coin holder, which will give the audience an illusion that the coin is pierced with the key.

4 Claims, 4 Drawing Sheets

COIN MAGIC DEVICE

The resent invention relates to a coin magic device, and more particularly, to a magic device adapted for a coin put in a case to appear as if it were pierced with a key.

SUMMARY OF THE PRESENT INVENTION

The present invention has an object to provide a coin magic device having a simple structure and which is very easy to use.

The above object is attained by providing a coin magic device comprising, according to the present invention, a coin holder formed like a plate, having formed in the center thereof a generally circular concavity having a through-hole formed in the bottom thereof and in which a coin is to removably be held; a case for receiving the coin holder therein, composed of two opposite members, upper and lower, made of an opaque material, each having a slot formed in a position corresponding to the through-hole in the coin holder; and a piercing piece which is to be penetrated through the case from one of the slow toward another. The circular concavity in the coin holder is so deep that one side of a coin set therein is generally flush with the space of the coin holder and the through-hole in the coin holder has such a size that the piercing piece can be passed through it. The case has formed therein an opening through which the coin holder can be put into, and taken out of, the case in a direction nearly perpendicular to a line connecting the two slots in the case. The case has formed on the inner surface thereof which faces the concavity side of the coin holder a guide wall which guides the coin moving from a set position to a offset position. In the set position, the coin lies on a straight line connecting the slits, while in the offset position, the coin lies away from the straight line.

When the coin holder carrying the coin set in the concavity thereof is introduced into place inside the case from the opening of the case while the concavity side of the coin holder is being held upside, the coin is set in the set position. Further, when the piercing piece is inserted through one of the slits in the case while the case is being held vertically for the set position to be lower than the offset position, the coin is forced out of the concavity in the coin holder by the inserted piercing piece and moves as guided by the guide wall from the set positioning to the offset position. Thus the piercing piece can be further inserted through the through-hole in the coin holder and the other slit, which gives the audience an illusion that the coin is pierced with the piercing piece.

The manner in which the object mentioned above and other objects of the present invention are achieved will be evident in the more detailed description of a preferred embodiment of the present invention which will now be set forth in reference to the drawings.

BRIEF DESCRIPTION OF THE DRAWINGS

FIG. I is a perspective view of a preferred embodiment of the coin magic device according to the present invention.

DETAILED DESCRIPTION OF THE PREFERRED EMBODIMENT

Figure 1:
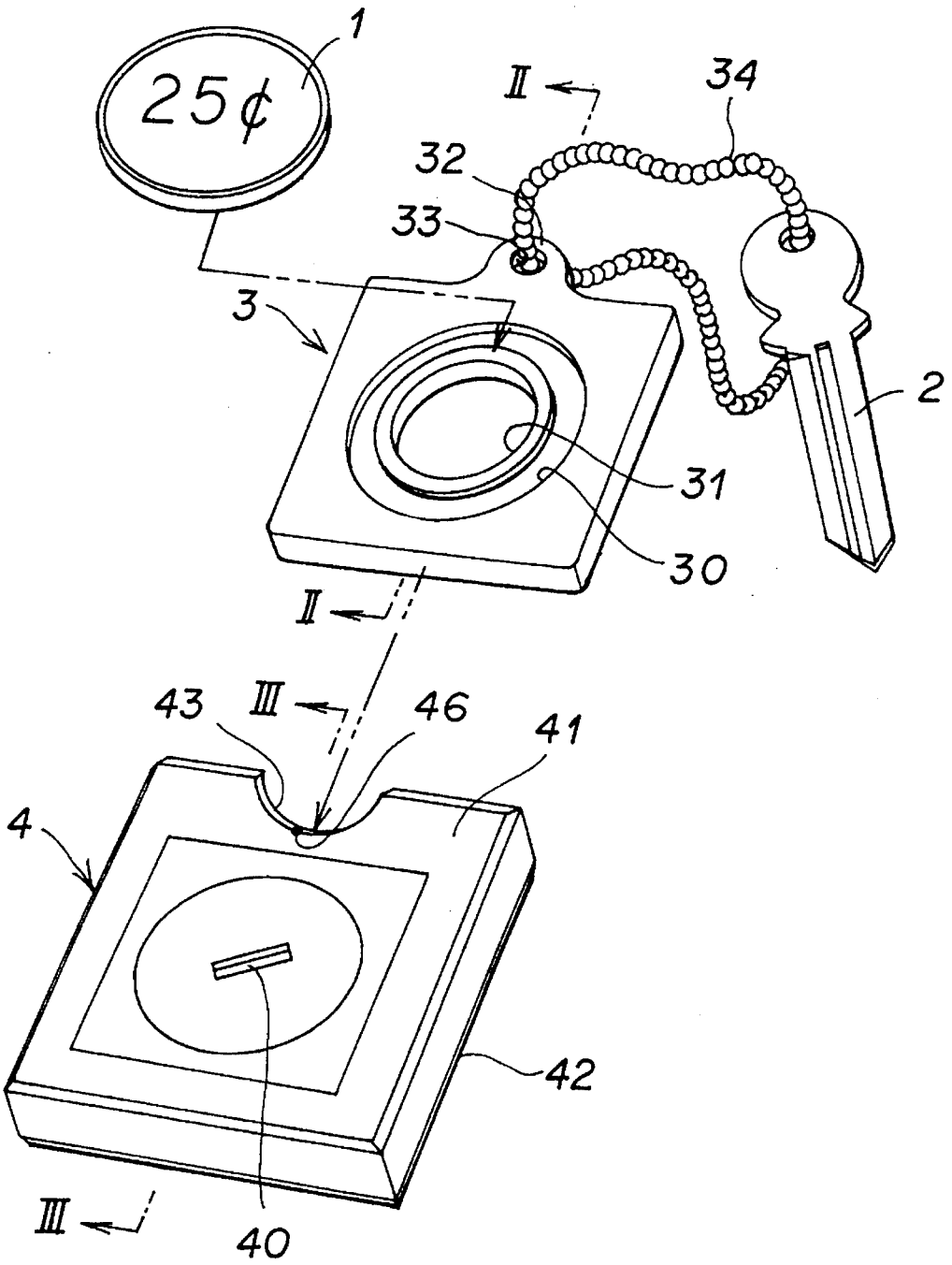
Figure 2:
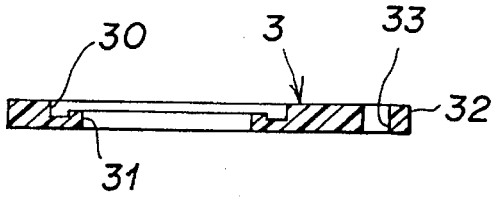
FIG. 2 is a sectional view taken along the line II—II in FIG. 1.

As illustrated in the drawings, the coin magic device according to the present invention comprises a coin-like piece 1, for example, a 25¢ coin, a key 2, made of a metal, for instance, as a piercing piece and having a through-hole formed in the bow thereof, a coin holder 3 in which the coin 2 is to be set, and a case 4 which receives the coin 1 and coin holder 3.

The coin holder 3 has the form of a square plate made of a synthetic resin, for example. The coin holder 3 has formed on one side thereof a circular concavity 30 having such a depth that the coin 1 set therein is nearly flush with the surface of the coin holder 3. The coin 1 is removably held in the concavity 30. The coin holder 3 has formed in the bottom of the concavity 30 thereof a circular through-hole 31 through which the blade of the key 2 can be passed. The coin holder 3 has a generally semicircular projection 32 formed integrally at the center on one side thereof. The projection 32 has a small circular through-hole 33 formed therein. A chain 34 is passed through the through-hole 33 and the through-hole formed in the bow of the key 2. The key 2 is thus retained on the chain 34.

The coin holder 3 may have formed therein a slit through which the key 2 can also be passed, instead of the circular through-hole 32. In this case, the slit is formed to have a nearly same size as two slits formed in the case 4 as will be described later.

As mentioned above, the coin holder 3 is to be received into the case 4. The case 4 is made of an opaque material and has a thin square form. It is composed of two members: upper case member 41 and lower case member 42. The case 4 has formed in one end face thereof an opening 43 through which the coin holder 3 having the coin 1 set therein is to be introduced into, and taken out of, the case 4. The case 4 has an inner space 44 defined between the upper and lower case members 41 and 42 and which communicates with the opening 43. Each of the upper and lower case members 41 and 42 has a semicircular cut formed in the edge portion thereof corresponding to the opening 43. These cuts facilitate to draw out the coin holder 3 from inside the case 4. The upper case member 41 has a small white round marking 46 provided on the front surface thereof near the circumferential center of the cut edge of the upper case member 41 or in any other appropriate position on the front surface. The marking 46 provides for an identification of the front side of the case 4. As briefly referred to above, the upper and lower case members 41 and 42 have slits 40 formed nearly in the centers thereof, respectively. The slits 40 are located opposite to the through-hole 31 in the coin holder 3 set in place in the inner space 44 of the case 4, that the blade of the key 2 can be passed through the slits 40.

Figure 3:
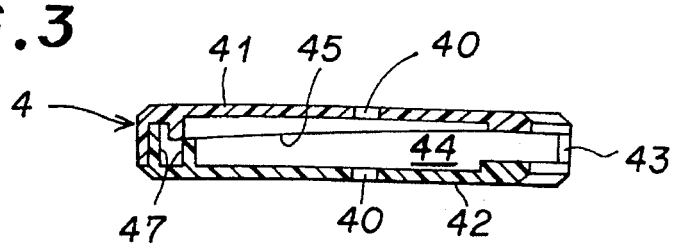
FIG. 3 is a sectional view taken along the line III—III in FIG. 1.
Figure 4:
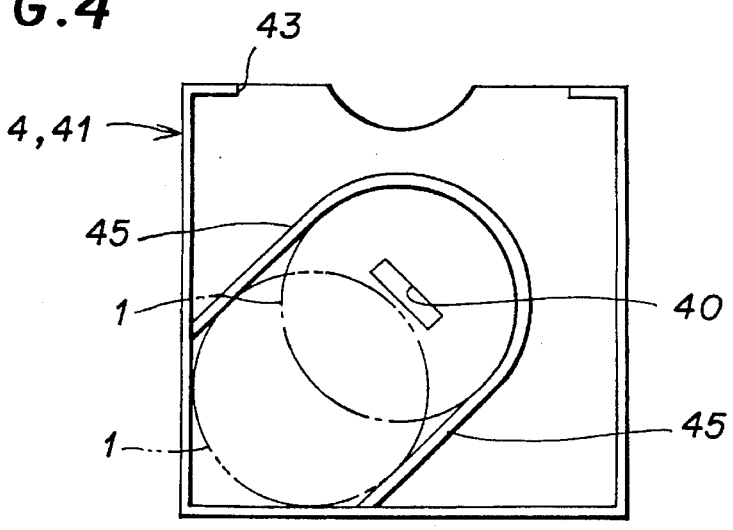
FIG. 4 is a rear view of the upper case member.

As shown in FIG. 4, the upper case member 41 has formed on the inner surface thereof as projected toward the lower case member 42 a guide wall 45 to guide the coin 1 moving between a set position indicated with a dashed line and a offset position indicated with a two dot chain line. In the set position, the coin 1 lies on a straight line connecting the slits 40. In the offset position, the coin 1 lies away from the straight line. The guide wall 45 consists of a semicircular portion at the regular-position side and two parallel portions at the parking-position side. The height of the guide wall 45 is increased from the set position toward the offset position as shown in FIG. 3. Also, a portion the upper case member 41 that is enclosed with the guide wall 45 (in which the coin 1 moves) is a little smaller in thickness than the other portion.

Figure 5:
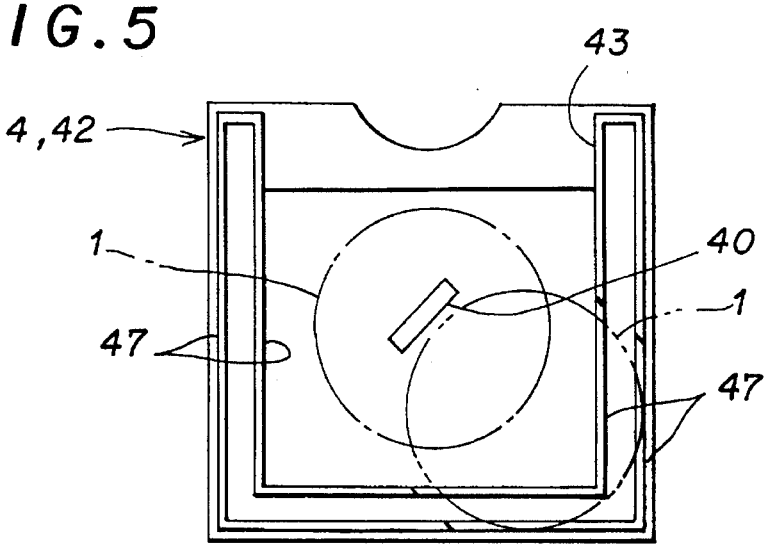
FIG. 5 is a rear view of the lower case member.

As shown in FIG. 5, the lower case member 42 has a double wall 47 of which the inner wall defines a square inner space into and from which the coin holder 3 is received and drawn out. A portion of the double wall 47 that corresponds to the offset position is somewhat lower than the other portion.

Figure 6:
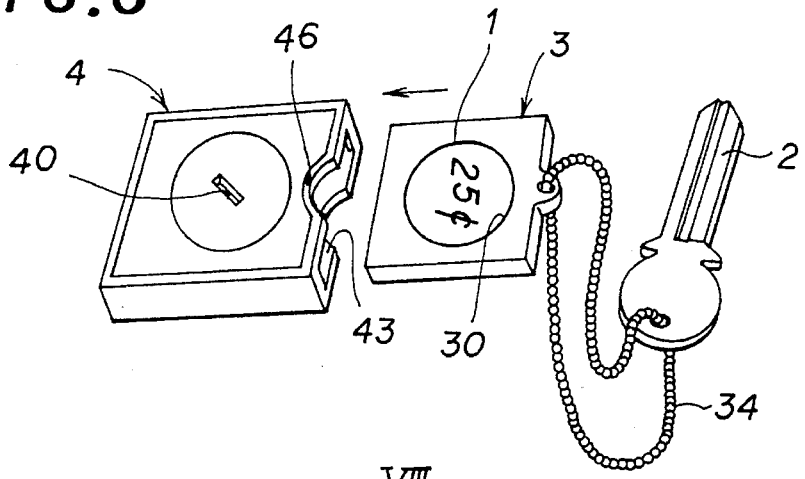
FIG. 6 is an explanatory drawing showing the coin and coin holder going to be introduced into the case.
Figure 7:
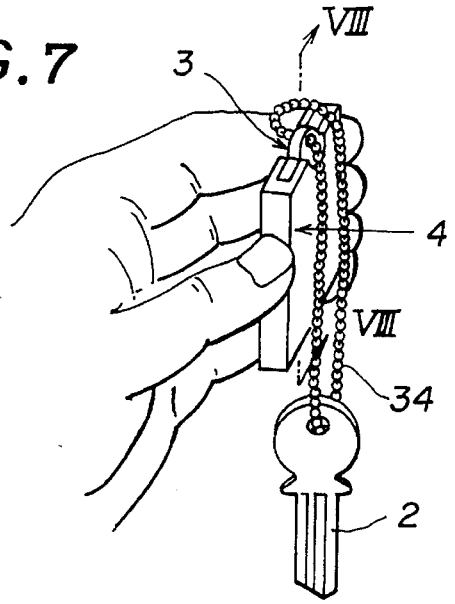
FIG. 7 is an explanatory drawing showing the coin and coin holder put in the case.
Figure 8:
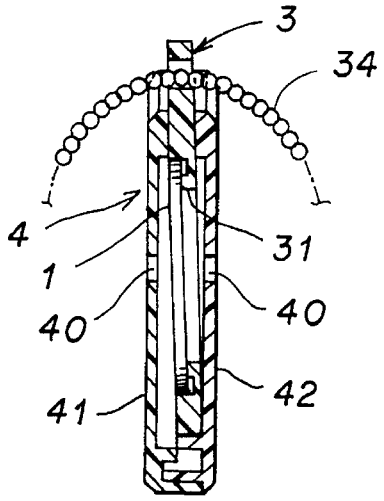
FIG. 8 is a sectional view taken along the line VIII—VIII in FIG. 7.
Figure 9:
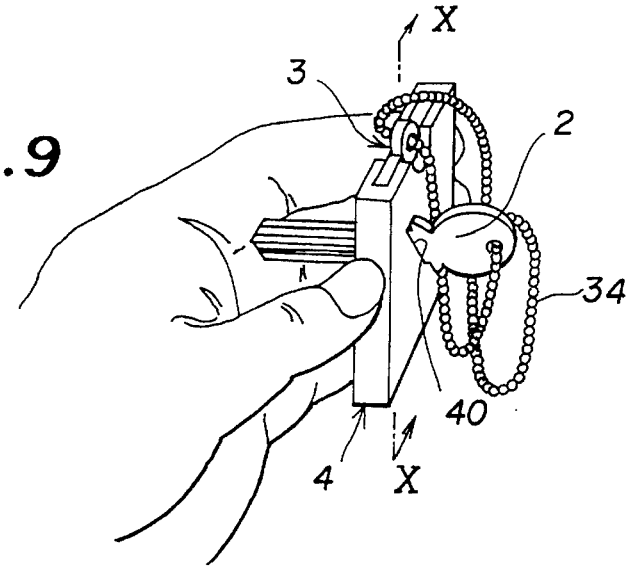
FIG. 9 is an explanatory drawing showing the case pierced with the key blade.
Figure 10:
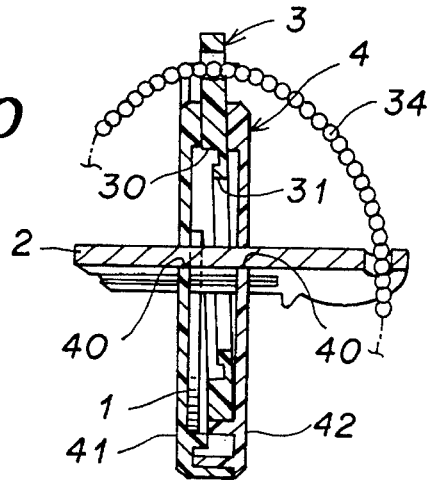
FIG. 10 is a sectional view taken along the line X—X in FIG. 9.
Figure 11:
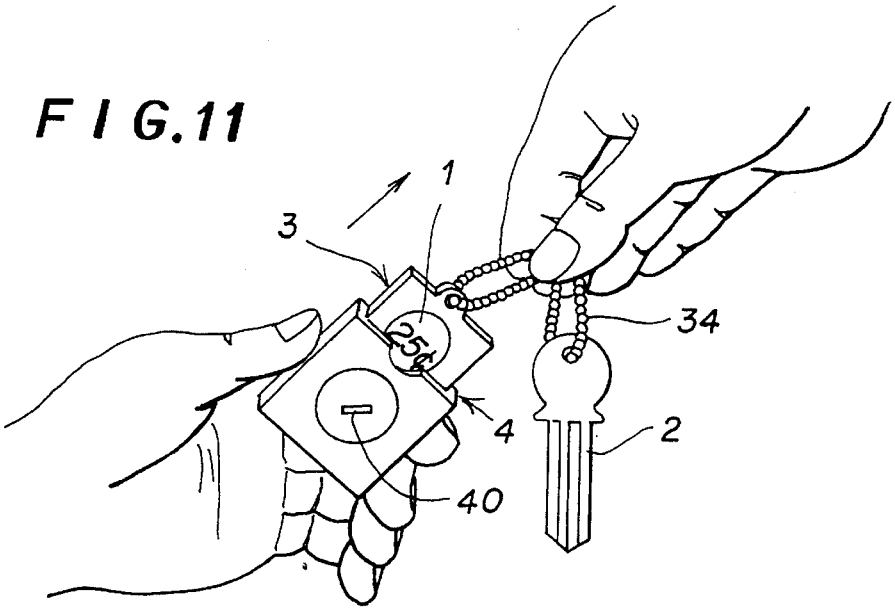
FIG. 11 is an explanatory drawing showing the coin and coin holder being taken out of the case.

How to use the device according to the present invention will be described herebelow:

First, the coin 1 is set in the concavity 30 of the coin holder 3. The coin holder 3 carrying the coin 1 thereon is introduced into the case 4. This introduction should be done carefully. Namely, the side of the coin holder 3 on which the coin 1 is held has to be on the side of the upper case member 41 (the marking 46 provided on the surface of the upper case member 41 will facilitate to verify this orientation), and the coin holder 3 should be introduced as held horizontally into the case 4 also held horizontally, from the opening 43, as shown in FIG. 6. After that, the case 4 is held generally vertically for the offset position to be lower than the set position as illustrated in FIGS. 7 and 8. Next, the key 2 is inserted into the slit 40 in the lower case member 41 and then into the through-hole 31 in the coin holder 3 (as illustrated in FIG. 9). At this step, the coin 1 will be forced out of the concavity 30 in the coin holder 3, and moves as guided by the guide wall 45, from the set position indicated with the dashed line to the offset position indicated with the two dot chain line (as in FIGS. 4 and 5). Thus, the key 2 can be passed through the through-hole 31 in the coin holder 3 and then the slit 40 in the upper case member 41. FIG. 10 shows that the blade of the key 2 has penetrated through the case 4.

The audience has surely seen the coin 1 set in the concavity 30 of the coin holder 3 and then put into the case 4. So they will not get any idea that the coin 1 can be moved inside the case 4. In addition, they cannot see the coin 1 have moved from the set position to the offset position since it is hidden by the opaque case 4. Thus, the audience will be given an illusion that the coin 1 is pierced with the key 2.

After that, the case 4 is turned over for the offset position to be upside, and the key 2 is taken out from the slits 40 of the case 4 and through-hole 31 of the coin holder 3. The coin 1 will move reversely from the offset position to the set position. Next, the case 4 is held for the upper case member 41 to be upside so that the coin 1 is held again in the concavity 30 of the coin holder 3. Thereafter, the coin holder 3 is drawn out of the case 4 and it is displayed to the audience that the coin 1 is held in the concavity 30 in the coin holder 3 (as illustrated in FIG. 10).

What is claimed is:

1. A coin magic device, comprising:

a coin holder formed like a plate, having formed in the center thereof a generally circular concavity having a through-hole formed in the bottom thereof and in which a coin is to removably be held;

a case for receiving said coin holder therein, composed of two opposite members, upper and lower, made of an opaque material, each having a slot formed in a position corresponding to said through-hole in said coin holder; and a piercing piece which is to be penetrated through said case from one of said slots toward another;

said circular concavity in said coin holder being so deep that one side of said coin set therein is generally flush with the surface of said coin holder, said through-hole in said coin holder and two slits in said case having such a size that said piercing piece can be passed through them;

said case having formed on the inner surface thereof which faces the concavity side of said coin holder a guide wall which guides said coin moving between a set position lying on a straight line connecting said two slits in the case and a offset position located away from said straight line.

2. A coin magic device according to claim 1, wherein said through-hole has the form of a slot nearly same as those in said case.

3. A coin magic device according to claim 1, wherein said piercing piece is a key.

4. A coin magic device according to claim 3, wherein said key is retained to said coin holder by means of a chain.

* * * * *